US009240135B2

(12) United States Patent
Chan

(10) Patent No.: US 9,240,135 B2
(45) Date of Patent: Jan. 19, 2016

(54) CHROMATICITY ADJUSTMENT FOR LED VIDEO SCREENS

(71) Applicants: Lighthouse Technologies Limited, Shatin (HK); Lighthouse Technologies (Huizhou) Limited, Huizhou (CN)

(72) Inventor: Kui Lai Curie Chan, Hong Kong (CN)

(73) Assignee: Lighthouse Technologies, Ltd., Shatin (HK)

( * ) Notice: Subject to any disclaimer, the term of this patent is extended or adjusted under 35 U.S.C. 154(b) by 156 days.

(21) Appl. No.: 13/916,344

(22) Filed: Jun. 12, 2013

(65) Prior Publication Data

US 2014/0368551 A1 Dec. 18, 2014

(51) Int. Cl.

| | |
|---|---|
| ***G09G 5/00*** | (2006.01) |
| ***G09G 3/20*** | (2006.01) |
| ***G09G 3/32*** | (2006.01) |

(52) U.S. Cl.

CPC ..... *G09G 3/2003* (2013.01); *G09G 3/32* (2013.01); *G09G 2320/0693* (2013.01)

(58) Field of Classification Search

CPC ..... G09G 2300/02–2300/026
USPC ..... 345/1.1–3.4
See application file for complete search history.

(56) References Cited

U.S. PATENT DOCUMENTS

| | | | | |
|---|---|---|---|---|
| 2005/0219271 | A1* | 10/2005 | Tanaka | 345/690 |
| 2008/0055320 | A1* | 3/2008 | Fujimori | 345/501 |
| 2010/0085480 | A1* | 4/2010 | Katakame | 348/453 |

* cited by examiner

*Primary Examiner* — Long D Pham
(74) *Attorney, Agent, or Firm* — Schiff Hardin LLP

(57) ABSTRACT

A system and method for color matching/chromaticity adjustment for a video screen, display panel, module or other component that comprises different batches of light emitting diodes ("LEDs"). The system and method do not alter the panel/module's RGB gain when adjusting saturation, luminance and hue. This way, the panels and modules can achieve a desired/targeted white balance. As such, different batches of LEDs can be set to the same RGB ratios to achieve proper color matching. Thus, the system and method can mix different batches of LEDs in the same video screen or wall, yet achieve uniformity across the screen/wall.

23 Claims, 10 Drawing Sheets

CHROMATICITY ADJUSTMENT FOR LED VIDEO SCREENS

BACKGROUND OF THE INVENTION

The present disclosure relates to lighting devices and methods. In particular, the present disclosure relates to a method and system for chromaticity adjustment or color matching for a video display screen.

Today, it is common for video displays to use light emitting diodes ("LEDs") because of the brightness and low power requirements of the LEDs. LED video screens are used as digital billboards to display e.g., advertisements, textual and/or graphical informational messages, and live or prerecorded videos throughout cities and towns and at sporting events, concerts, and other appropriate venues (e.g., inside or outside of buildings). LED video screens, also referred to as LED display walls, are made up of individual panels and/or intelligent modules (IM) having a predetermined number and arrangement of controllable LEDs. The panels and/or modules are mounted next to each other and their outputs are controlled such that they appear to be one large display screen.

The LEDs used in the LED video screen, etc. are usually red, green or blue ("RGB") LEDs whose output can be controlled such that the RGB components mix according to known principles to create any visible color (including black and white). Unfortunately, the batches of LEDs that are used for the modules, panels, etc. may have different wavelengths of color due to e.g., their composition, manufacturing and/or other differences. This means that the LEDs on the individual panels and modules may have different output coloring from panel to panel and module to module. Since video screens comprise multiple panels and/or modules placed next to each other, uniformity of the screen's output will be affected by the color differences between the LED batches.

Sometimes, when constructing an LED video screen, panels and/or modules are discarded when it is determined that there are color differences between the other panels and/or modules in the screen. That is, only compatible panels and modules are used, so that screen uniformity can be achieved as best as possible. This, however, wastes resources and can be expensive. Moreover, exact color uniformity is not guaranteed.

There have been attempts to adjust the LED video screen's uniformity by adjusting the saturation, luminance and hue of the panels making up the screen. This is often referred to as chromaticity adjustment or color matching. These attempts, however, necessarily alter the RGB output gain, which also affects the output white balance of the panels/modules. Therefore, uniformity based on the saturation, luminance and hue adjustments will not be achieved because the panels/modules will have different RGB gain and white balancing. Likewise, if a target white balance is desired between the panels and modules, then uniformity will not be achieved because of the different RGB ratios. Thus, these techniques are not desirable and will not result in a uniform screen output.

Accordingly, there exists a need to provide an improved color matching/chromaticity adjustment technique for a video screen, display panel, module or other component comprising different batches of light emitting diodes.

BRIEF SUMMARY OF THE INVENTION

In consideration of the above problems, in accordance with one aspect disclosed herein, a method of performing color matching for a light emitting video screen comprising a plurality of light emitting panels arranged in a layout is provided. The method comprises generating, at a processor, master data from an output of a first light emitting panel of the plurality of light emitting panels; generating, at the processor, correction data for each remaining light emitting panel, the respective correction data being based on a respective output of a respective remaining light emitting panel and the master data; assigning, at the processor, the master data associated with the first light emitting panel to a location in the layout corresponding to a location of the first light emitting panel in the screen; and for each remaining light emitting panel, assigning, at the processor, the correction data associated with a respective remaining light emitting panel to a location in the layout corresponding to a location of the respective remaining light emitting panel in the screen.

In another embodiment, a video processor is provided. The video processor is programmed to execute a method of performing color matching for a light emitting video screen comprising a plurality of light emitting panels arranged in a layout. The video processor is programmed to generate master data from an output of a first light emitting panel of the plurality of light emitting panels; generate correction data for each remaining light emitting panel, the respective correction data being based on a respective output of a respective remaining light emitting panel and the master data; assign the master data associated with the first light emitting panel to a location in the layout corresponding to a location of the first light emitting panel in the screen; for each remaining light emitting panel, assign the correction data associated with the respective remaining light emitting panel to a location in the layout corresponding to a location of the respective remaining light emitting panel in the screen; and perform color matching on the remaining light emitting panels in the screen based on the respective correction data.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

In accordance with preferred embodiments disclosed herein, a system and method of color matching for a video screen, display panel, module or other component comprising different batches of light emitting diodes is provided. The disclosed system and method do not alter the panel/module's RGB gain when adjusting saturation, luminance and hue. This way, the panels and modules can achieve a desired/targeted white balance. As such, different batches of LEDs can be set to the same RGB ratios to achieve proper color matching. Thus, the disclosed system and method can mix different batches of LEDs in the same video screen or wall, yet achieve uniformity across the screen/wall. The disclosed system and method will not waste LED panels or modules, ensures uniformity in an efficient manner and are less costly to implement than today's color matching schemes.

Figure 1:
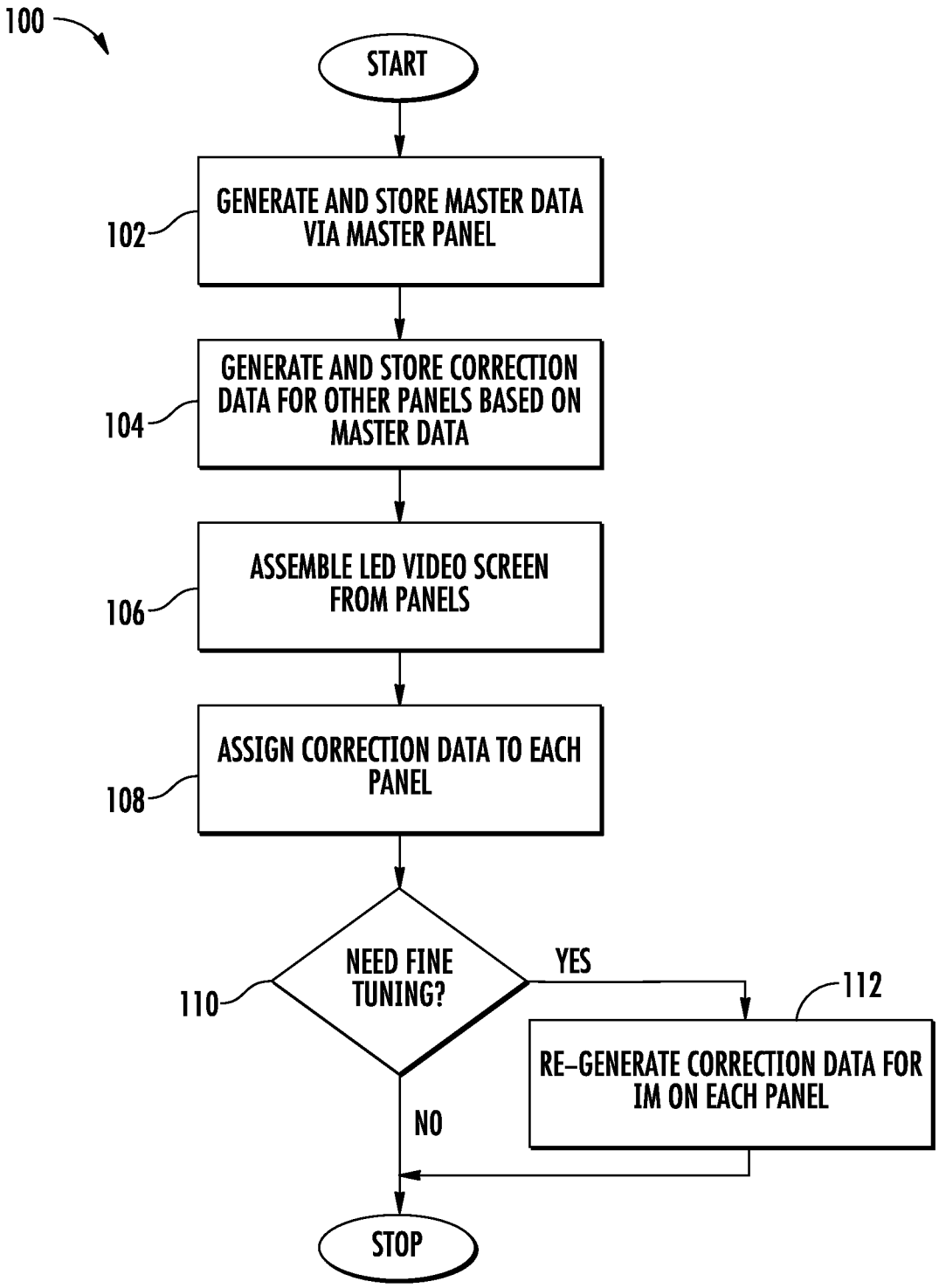
FIG. 1 illustrates a method of performing chromaticity adjustment of display panels and modules used in an LED video screen in accordance with disclosed principles.

FIG. 1 illustrates a method 100 of performing chromaticity adjustment (i.e., color matching) of display panels and modules used in an LED video screen in accordance with the disclosed principles. The method 100 preferably uses a system 200 such as the one illustrated in FIG. 2. In the illustrated system 200, a camera 204 is used to take an image or a plurality of images of the output of a panel 202 to be used in an LED video screen or wall. As is described below with reference to method 100, the panel 202 could be a master panel used to obtain master data (in which all other panels used in the screen are calibrated against/adjusted to) or the panel 202 could be one of the other panels used in the screen (referred to herein as an "adjusted panel"). The system 200 also comprises a monitor 206 for displaying the image 212 of the output of the panel 202. A marker 214 is also displayed on the monitor 206. As is described below, the marker 214 is used to select a portion of the image 212 to focus on and collect relevant data to be used in the method 100.

The system 200 also comprises a processor 210, which controls and drives the panel 202 through one output (OUT1) connected to the panel 202 via a wired or wireless connection. The processor 210 also drives the monitor 206 using a monitor output (MONITOR OUT) via a wired or wireless connection. The processor 210 inputs image and other data from the camera 204 via e.g., a serial digital interface input (SDI IN) via a wired or wireless connection. It should be appreciated that the processor 210 can input digital data via a digital visual interface (DVI) if desired. In a desired embodiment, the processor 210 is part of the control panel/module that operates the LED video screen. For example, the processor 210 could be the video processor for the control panel/module.

The method 100 may be implemented in software or hardware. In a desired embodiment, the method 100 is implemented in software, stored in a computer readable medium, which could be a random access memory (RAM) device, non-volatile random access memory (NVRAM) device, or a read-only memory (ROM) device) and executed by the processor 210 or other suitable controller for the video screen. The method 100 begins by placing a panel 202 (that will serve as the master panel) in the system 200 and generating master data from that panel 202 (step 102). As noted above, the master data is the data that all other panels used in the LED video screen are calibrated against/adjusted to. The master data is generated by placing a marker 214 within the panel image 212 and inputting the white balance/gain (Rgain, Ggain, Bgain), chromaticity (R Rg, Rb, G, Gr, Gb, B, Br, Bg), hue and luminance information output from the red, green and blue LEDs within the marker's 214 region.

Figure 3:
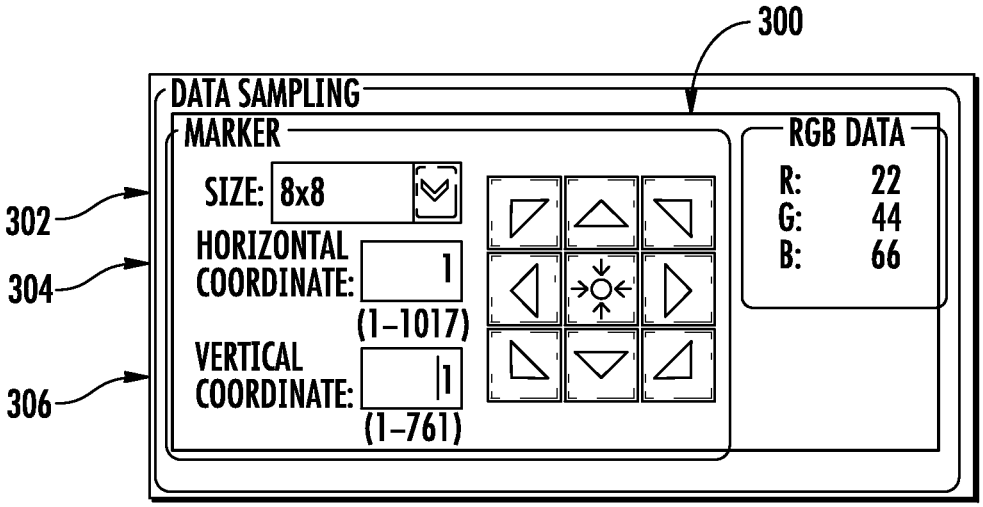
FIG. 3 illustrates an example interface for placing a data sampling marker on an image displayed by the FIG. 2 monitor.

In a desired embodiment, the size and location of the marker are adjustable via a graphical user interface (GUI) displayable on the monitor 206 or another control panel interface. FIG. 3 illustrates a sample graphical user interface 300 used to set the marker's 214 size and location on the monitor 206. The example interface 300 includes a first control menu/selection 302 for setting the size of the marker 214 (e.g., 8 pixels by 8 pixels). The example interface 300 also includes a second control menu/selection 304 for setting the starting horizontal coordinate of the marker 214 and a third control menu/selection 306 for setting the starting horizontal coordinate of the marker 214.

Figure 4:
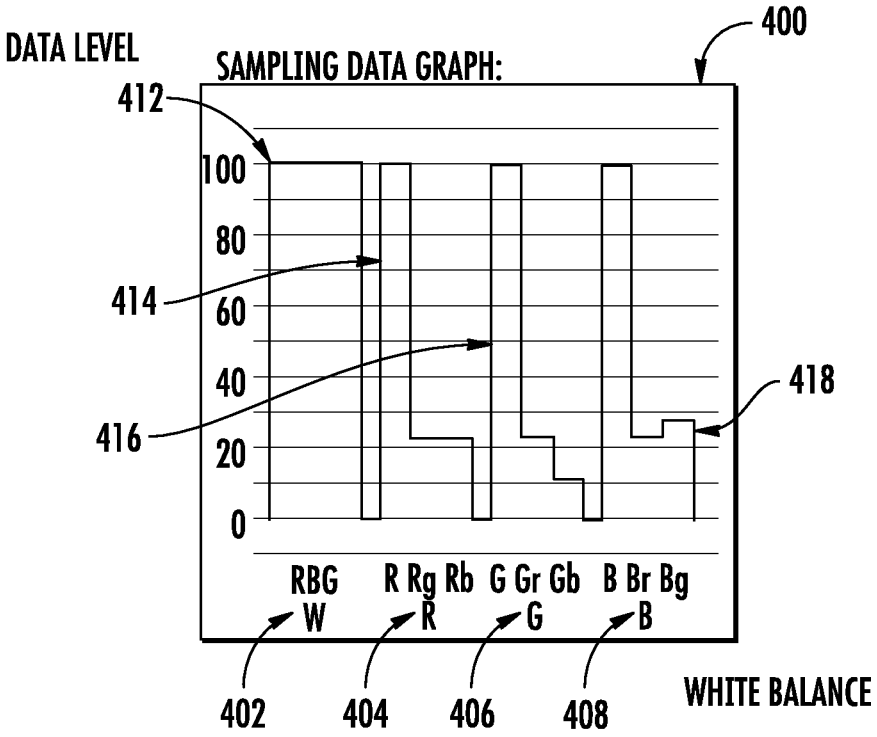
FIG. 4 illustrates an example sampling graph showing master data in accordance with the disclosed principles.

In a desired embodiment, the sampled white balance/gain (Rgain, Ggain, Bgain), chromaticity (R Rg, Rb, G, Gr, Gb, B, Br, Bg), hue and luminance information can be output on the monitor 206 as a data graph 400 such as the one shown in FIG. 4. The example graph 400 illustrated in FIG. 4 contains a Y-axis corresponding to the data level and an X-axis corresponding to a white balance portion 402, red chromaticity portion 404, green chromaticity portion 406 and blue chromaticity portion 408. Graphs 412, 414, 416, 418 are illustrated and correspond to values for each respective portion 402, 404, 406, 408. It should be appreciated that the values making up the graph portions 412, 414, 416, 418 can also be displayed in numerical form, if desired. It should be appreciated that the sampled white balance/gain (Rgain, Ggain, Bgain), chromaticity (R, Rg, Rb, G, Gr, Gb, B, Br, Bg), hue and luminance information are stored as master data in the processor 210 or in a memory associated with the processor 210. Moreover, the master data could also be numbered as a set of correction data (e.g., correction data set 1). This number can then be written on a portion of the master data panel that will not be visible once the LED video screen is constructed.

Once the master data is stored, the method 100 continues at step 104 where another panel 202 (i.e., a panel that will serve as an adjusted panel) is placed in the system 200. The image 212 of the output of the adjusted panel 202 is displayed on the monitor 206 and a marker 214 (of a similar size used to collect master data in step 102) is placed over the image 212. The same interface (e.g., interface 300) used to position the marker 214 to collect master data can be used to position the marker 214 to collect correction data, if desired. Once positioned, the processor 210 initiates a calibration/adjustment of the panel 202 based on its output image 212 and the master data collected at step 102. It should be appreciated that the interface 300 could include a "calibration" or "adjustment" selection to initiate the calibration/adjustment of the panel 202 if desired, or the calibration/adjustment can occur once the marker 214 is positioned. Based on the calibration of the panel 202, "correction data" is input and stored by the processor 210. The "correction data" includes the same type of information as the master data. That is, correction data will also include white balance/gain (Rgain, Ggain, Bgain), chromaticity (R Rg, Rb, G, Gr, Gb, B, Br, Bg), hue and luminance information output from the red, green and blue LEDs within the marker's 214 region as adjusted based on the master data.

Figure 5:
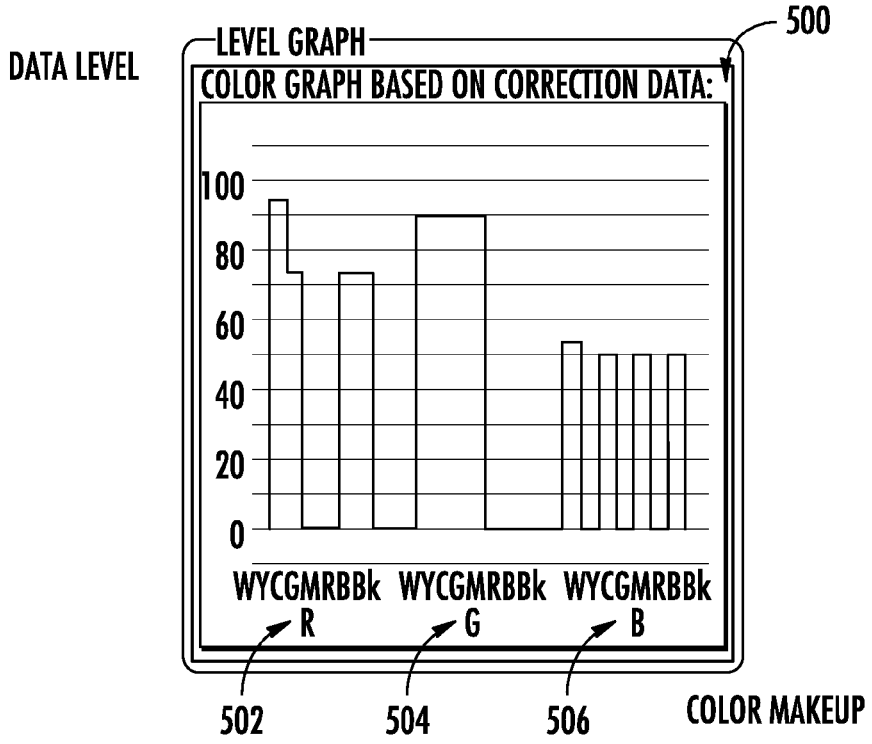
FIG. 5 illustrates an example color graph showing correction data in accordance with the disclosed principles.

In a desired embodiment, the correction data is displayed on a color graph 500 such as the example graph shown in FIG. 5. The example graph 500 contains a Y-axis corresponding to the data level and an X-axis corresponding to the color makeup of the displayed red component 502, green component 504 and blue component 506. The color makeup for each component 502, 504, 506 includes white (W), yellow (Y), cyan (C), green (G), magenta (M), red (R), blue (B) and black (Bk). It should be appreciated that the displayed levels making up the illustrated components 502, 504, 506 can also be displayed in numerical form, if desired.

Figure 6:
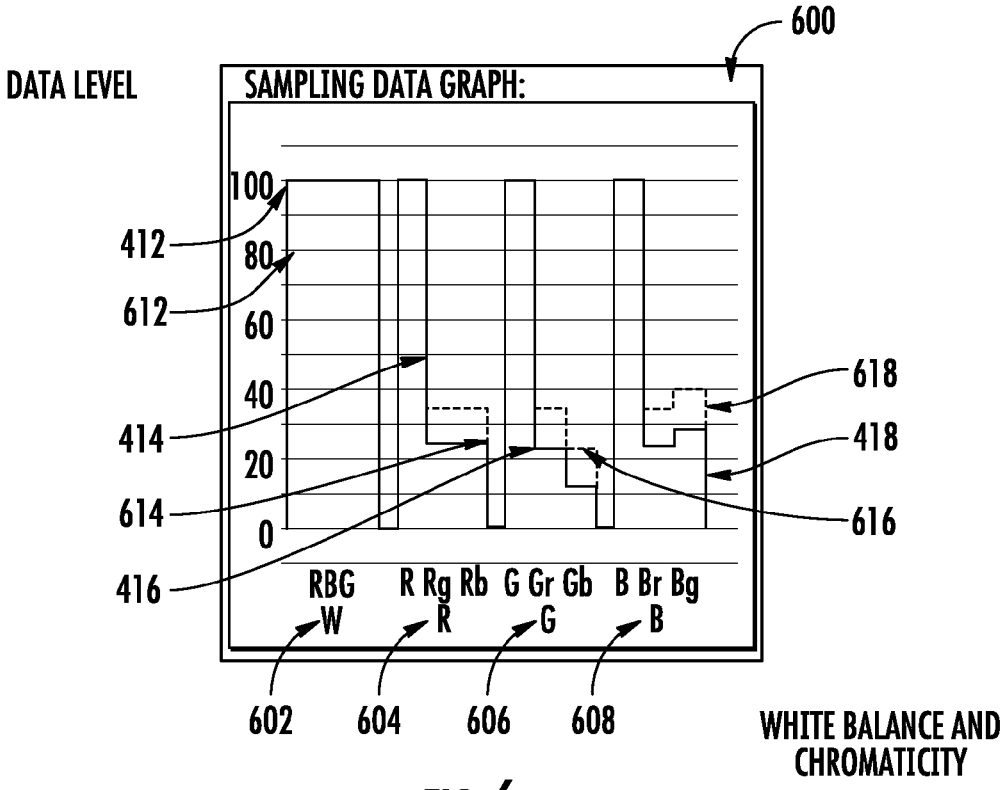
FIG. 6 illustrates an example sampling data graph showing master data and correction data in accordance with the disclosed principles.

In a desired embodiment, the correction data's white balance/gain (Rgain, Ggain, Bgain), chromaticity (R Rg, Rb, G, Gr, Gb, B, Br, Bg), hue and luminance information can be output on the monitor 206 as a sampling data graph 600 such as the one shown in FIG. 6. The example graph 600 contains a Y-axis corresponding to the data level and an X-axis corresponding to a white balance portion 602, red chromaticity portion 604, green chromaticity portion 606 and blue chromaticity portion 608. Graphs 612, 614, 616, 618 are illustrated and correspond to corrected data values for each portion 602, 604, 606, 608 (overlaid on top of the previously illustrated graphs 412, 414, 416, 418 for the master data). It should be appreciated that the values making up the graphs 612, 614, 616, 618 can also be displayed in numerical form, if desired.

The graph 600 provides an easy way to compare the correction data (i.e., portions 612, 614, 616, 618) to the master data (i.e., portions 412, 414, 416, 418). Based on the comparison, it may be desirable to adjust the correction data at this point to ensure that all of the data falls within a predetermined acceptable level. Therefore, in one embodiment, as part of step 104, a user interface may be provided to allow any of the correction data's white balance/gain (Rgain, Ggain, Bgain), chromaticity (R Rg, Rb, G, Gr, Gb, B, Br, Bg), hue and luminance to be adjusted. The adjustments can be made at the module level. The process for fine tuning the correction data will be discussed below in more detail with reference to method step 112.

In a desired embodiment, the correction data's white balance/gain (Rgain, Ggain, Bgain), chromaticity (R Rg, Rb, G, Gr, Gb, B, Br, Bg), hue and luminance information are stored as a correction data set in the processor 210 or in a memory associated with the processor 210. Moreover, the correction data set is numbered (i.e., correction data set 2, etc.). This number can then be written on a portion of the adjusted panel that will not be visible once the LED video screen is constructed. Once all of the remaining panels to be used in the LED screen undergo step 104, and the associated correction data sets are recorded and numbered, the LED video screen can now be assembled (step 106).

Figure 7:
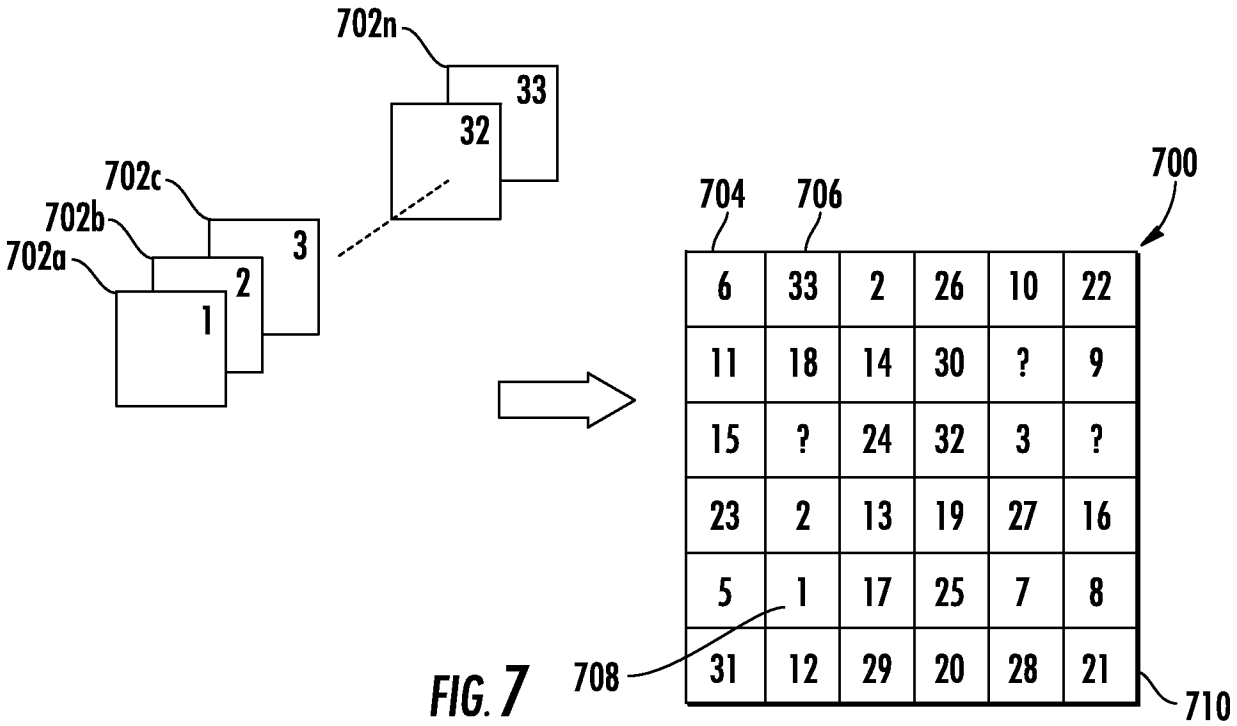
FIG. 7 illustrates a plurality of LED display panels and an LED video screen comprising the panels during the chromaticity adjustment process disclosed herein.

As shown in FIG. 7, a plurality of panels 702*a*, 702*b*, 702*c*, . . . 702*n* will be used to create the LED video screen. As mentioned above, each panel 702*a*, 702*b*, 702*c*, . . . 702*n* will have associated correction data based on steps 102 and 104 described above. At step 108, when the video screen is assembled, the processor 210 internally maintains a screen layout 700 and keeps track of the position a respective panel 702*a*, 702*b*, 702*c*, . . . 702*n* occupies in the screen layout 700. The processor 210 assigns the appropriate set of stored correction data for each panel 702*a*, 702*b*, 702*c*, . . . 702*n* to the appropriate screen layout 700 position. The information can be input e.g., based on the number written on the panel at step 102 or 104. As shown in the FIG. 7 example, screen layout position 704 has correction data set "6" assigned to it because the panel 702*a*, 702*b*, 702*c*, . . . 702*n* used in that position had correction data set "6" associated with it at method step 102 or 104. Likewise, screen layout position 706 has correction data set "33" assigned to it, screen layout position 708 has correction data set "1" assigned to it (e.g., this could be the master data set), and screen layout position 710 has correction data set "21" assigned to it. A panel can have no correction data, and in one embodiment would be assigned a null or zero value in its layout position so that the processor 210 recognizes that there is no correction data for that position. Moreover, it should be appreciated that more than one panel can have the same set of correction data.

Once all of the correction data has been assigned to the screen's layout, the method 100 continues at step 110 to see if any of the locations need fine tuning. As noted above, this "fine tuning" could have been performed during step 104 as each panel was being calibrated/adjusted. Moreover, the fine tuning could also have been performed as each panel was assigned a location in step 108, if desired. To determine if fine tuning is required, the operator can select a location within the screen layout 700 and view the correction data for the panel at that location (or the individual modules within the panel at that location). This can be done by any mechanism, including a GUI or other type of menu input. For example, the operator could move a pointer over location 704 and click on it to reveal the location's 704 relevant information (discussed below). The operator could also be provided with a mechanism for selecting the relevant information from individual modules making up the panel at the location 704. Once selected, the evaluation of whether fine tuning is needed can be made.

Figure 8:
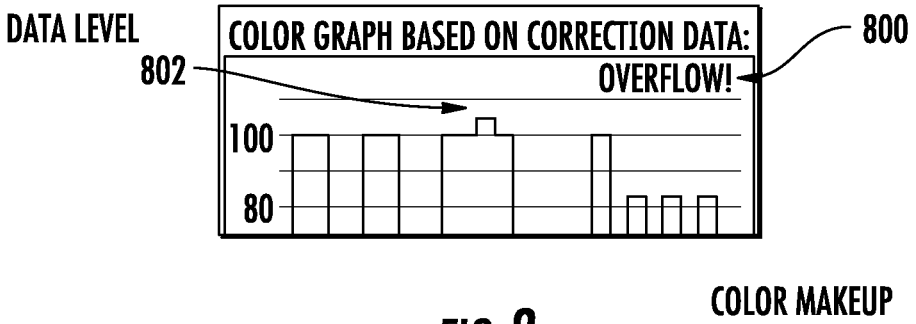
FIG. 8 illustrates an example color graph illustrating an overflow condition in accordance with the disclosed principles.
Figure 9:
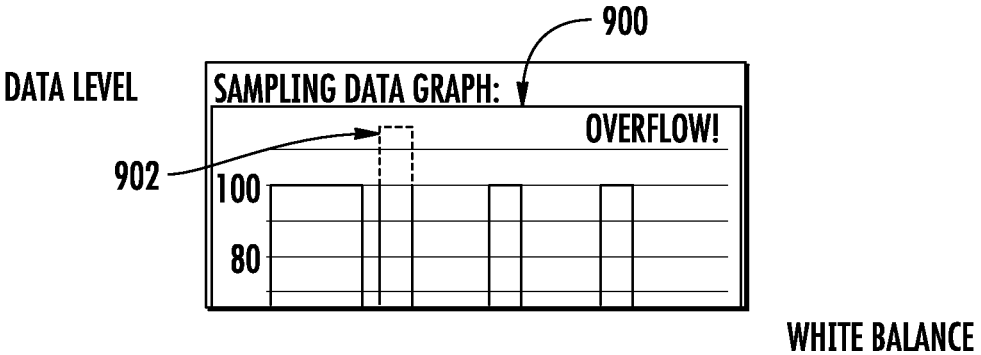
FIG. 9 illustrates an example sampling graph illustrating an overflow condition in accordance with the disclosed principles.

In one embodiment, determining whether fine tuning is required will involve an operator manipulating an interface (e.g., a GUI) to determine if the correction data of a panel (or the individual modules making up the panel) are outside predetermined boundaries. For example, correction data should not exceed the 100% level by more than a small amount (e.g., 10%) to prevent oversaturation of the panel's output coloring. Similarly, correction data should not be less than the 0% level by more than a small amount (e.g., 10%). It should be appreciated that these checks can be made by the user manually by viewing the sampling data graphs or color graphs. For example, FIG. 8, illustrates a color graph 800 where an overflow 802 has been detected. The overflow 802 indicates that fine tuning is required. Similarly, FIG. 9 illustrates a sampling data graph 900 where an overflow 902 has been detected. The overflow 902 indicates that fine tuning is required. It should also be appreciated that the checks at step 110 can be performed automatically by the processor 210 by comparing the correction data to the master data.

Figure 10:
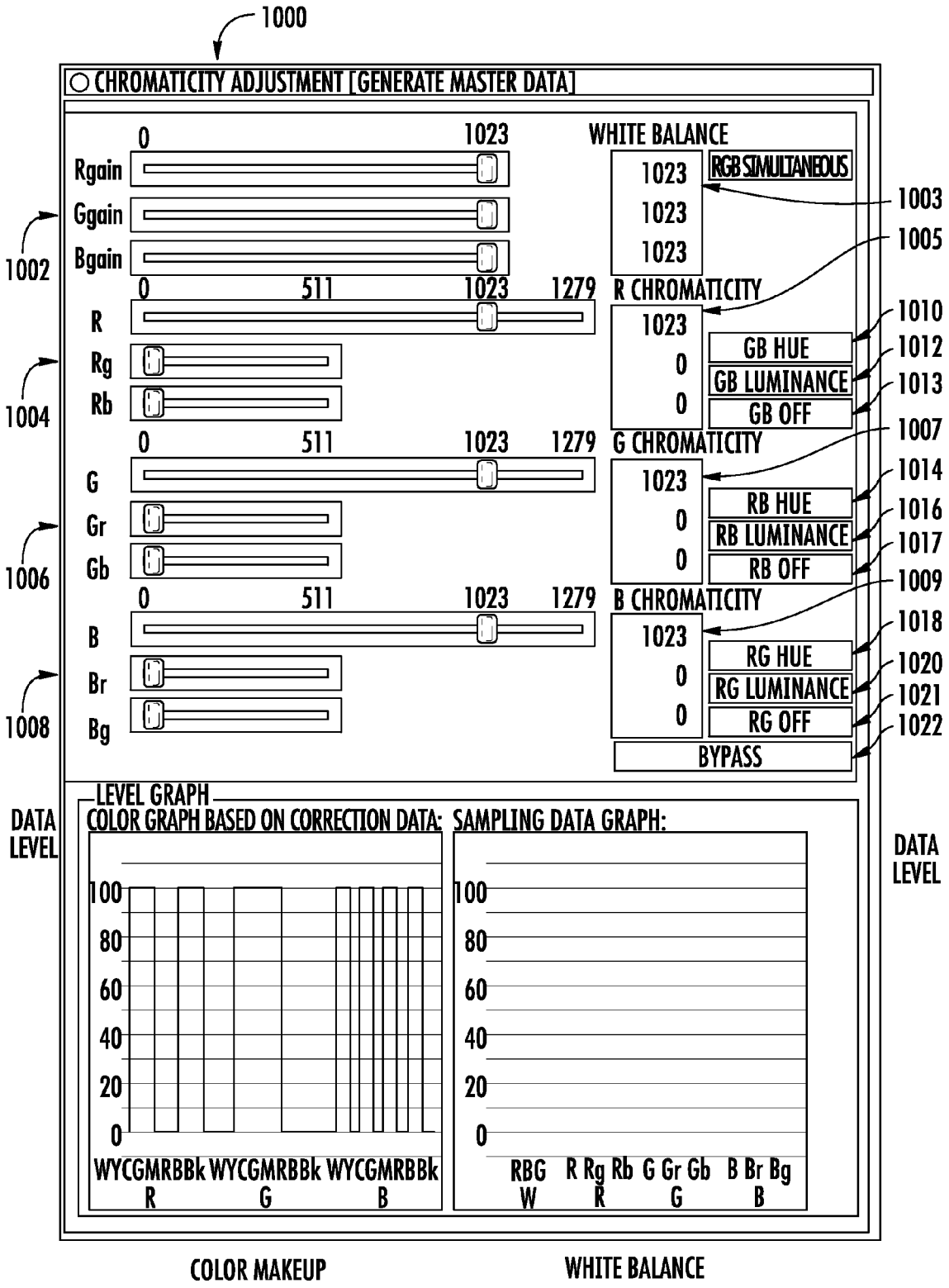
FIG. 10 illustrates an interface for fine tuning a location within the LED video screen in accordance with disclosed principles.

Regardless of how step 110 is performed, if there is no need for fine tuning, then the method 100 is completed. If, however, it is determined that any location, panel or individual module needs fine tuning, the method 100 continues at step 112, where correction data will be regenerated for the panel (or the individual modules (IM) making up the panel) at the location. Step 112 can be performed using a graphical user interface such as the GUI 1000 illustrated in FIG. 10 or by any other mechanism that will allow a user or the processor 210 to modify some of all of the correction data in the manner described below.

The example GUI 1000 includes sliders 1002 for adjusting Rgain, Ggain, Bgain, sliders 1004 for adjusting the red chromaticity components R, Rg, Rb, sliders 1006 for adjusting the green chromaticity components G, Gr, Gb, and sliders 1008 for adjusting the blue chromaticity components B, Br, Bg. The GUI 1000 can have a white balance display region 1003, red chromaticity display region 1005, green chromaticity display region 1007, and a blue chromaticity display region 1009. The GUI 1000 can have a green/blue (GB) hue selector 1010, a GB luminance selector 1012, a GB off selector, a red/blue (RB) hue selector 1014, an RB luminance selector 1016, a RB off selector 1017, a red/green (RG) hue selector 1018, an RG luminance selector 1020, a RG off selector 1021, and a bypass selector 1022. It should be appreciated that the present disclosure is not limited to the corrective measures shown on the GUI 1000. It should also be appreciated that a novel aspect of the present disclosure is to not change the white balance to ensure uniformity of all of the panels in the LED video screen. Thus, even though sliders 1002 are providing for adjusting the Rgain, Ggain, Bgain parameters, these parameters will not be adjusted to fine tune the panel or individual module.

The red chromaticity display region 1005 illustrates the value for the red component R as R=1023−(Rg+Rb)/2±Rsat, the green chromaticity display region 1007 illustrates the value for the green component G as G=1023−(Gr+Gb)/2±Gsat and the blue chromaticity display region 1009 illustrates the value for the blue component B as B=1023−(Br+Bg)/2±Bsat. Adjustments can be made by selecting any of the GB hue selector 1010, GB luminance selector 1012, RB hue selector 1014, RB luminance selector 1016, RG hue selector 1018, and RG luminance selector 1020 and then adjusting one of the chromaticity components using one of the sliders 1004, 1006, 1008. Adjustments will adhere to the following rules. When luminance is selected (via selector 1012, 1016 or 1020), if Rg is added (or subtracted), the same quantity of Rb is added (or subtracted), if Gr is added (or subtracted), the same quantity of Gb is added (or subtracted), and if Br is added (or subtracted), the same quantity of Bg is added (or subtracted). When hue is selected (via selector 1010, 1014 or 1018), if Rg is added (or subtracted), the same quantity of Rb is subtracted (or added), if Gr is added (or subtracted), the same quantity of Gb is subtracted (or added), and if Br is added (or subtracted), the same quantity of Bg is subtracted (or added). It should be noted that the selected fine tuning can be bypassed partially by selecting any of GB off selector 1013, RB off selector 1017, and RG off selector 1021, or completely by selecting the bypass selector 1022. This way, fine tuning can be performed again if the operator is not satisfied with the initial tuning. Once fine tuning is completed, the correction data can be stored to replace the prior version of the correction data or it can be stored as a new set of correction data. If stored as a new set of correction data, the location 704 on the layout 700 will need to be updated to reflect the new set of correction data.

Figure 2:
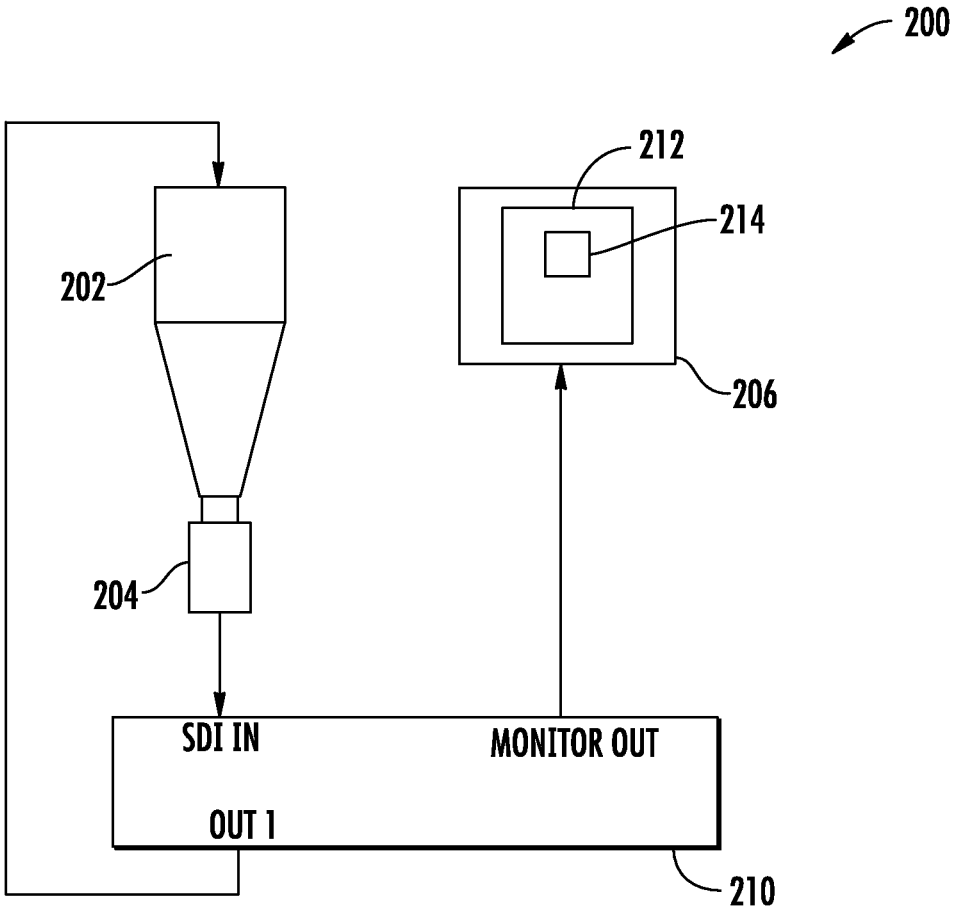
FIG. 2 illustrates a system for performing chromaticity adjustment of display panels and modules used in an LED video screen in accordance with disclosed principles.
Figure 11:
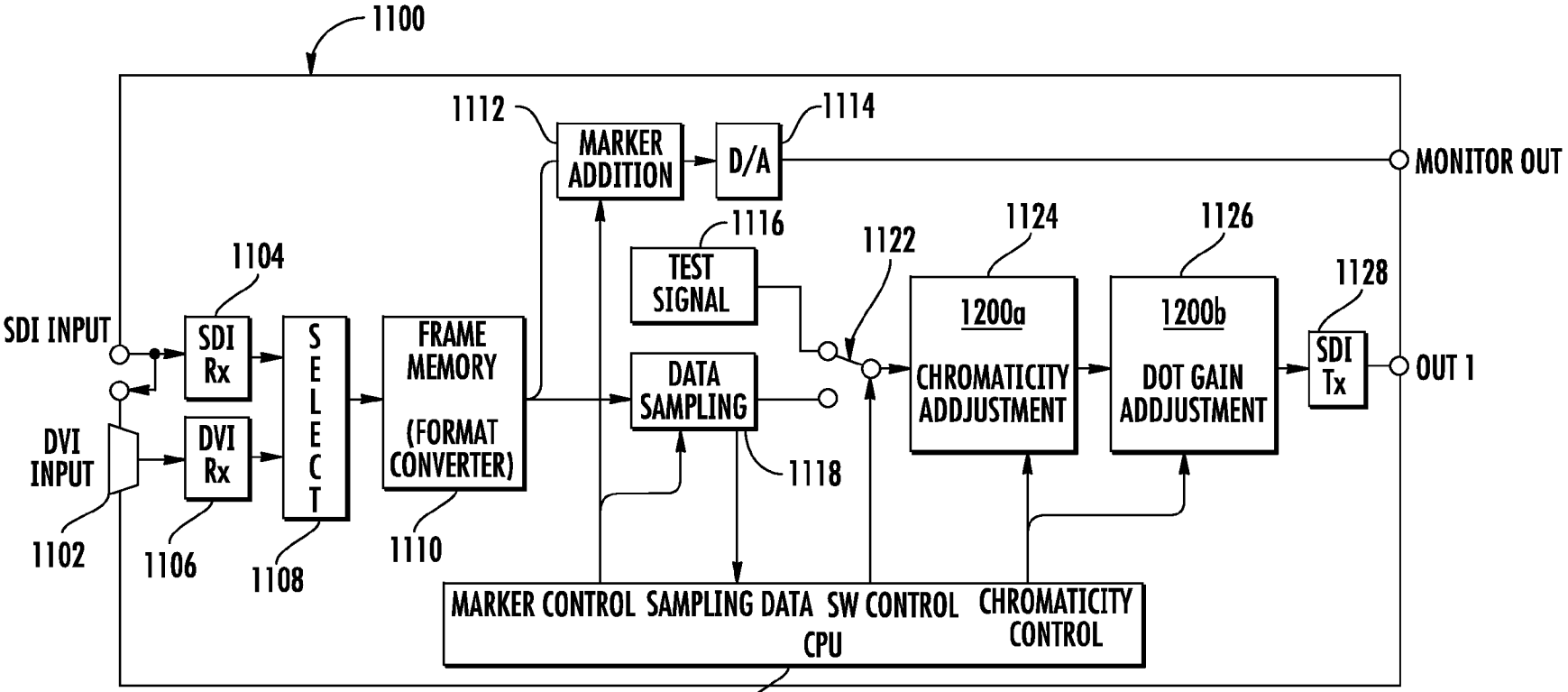
FIG. 11 illustrates an input and processing module for a video processor in accordance with disclosed principles.

FIG. 11 illustrates an input and processing module 1100 for the video processor 210 illustrated in FIG. 2. As can be appreciated, the module 1100 may be implemented in software or hardware.

The module 1100 has an SDI receiver portion 1104 for receiving SDI digital image data. The module 1100 may also have a DVI receiver portion 1106 for receiving DVI digital image data (via a multiplexer 1102). The type of input image data may be selected by a selection unit 1108 and sent to a format converter 1110 to be processed in accordance with an interlaced-to-progressive (I-to-P) function. A marker addition unit 1112 inputs the converted image data from converter 1110 and adds, from CPU 1120, marker control information identifying the selected portion of the image 212 with the marker 214, as discussed above with respect to FIGS. 2 and 3. Digital-to-analog converter 1114 converts the image data 212 with the marker 214 from digital to analog format, and outputs the converted data to monitor 206.

A data sampling unit 1118 also inputs both the converted image data and the marker control information identifying the selected portion of the image 212. CPU 1120 receives from data sampling unit 1118 sampling data for this selected portion of the image 212. Test signal unit 1116 provides a test signal for chromaticity adjustment. Switch 1122 is used to select, based on a switch control signal from CPU 1120, the test signal from test signal unit 1116 or sampled data from data sampling unit 1118 and pass the selected image data to a chromaticity adjustment module 1124.

Figure 12A:
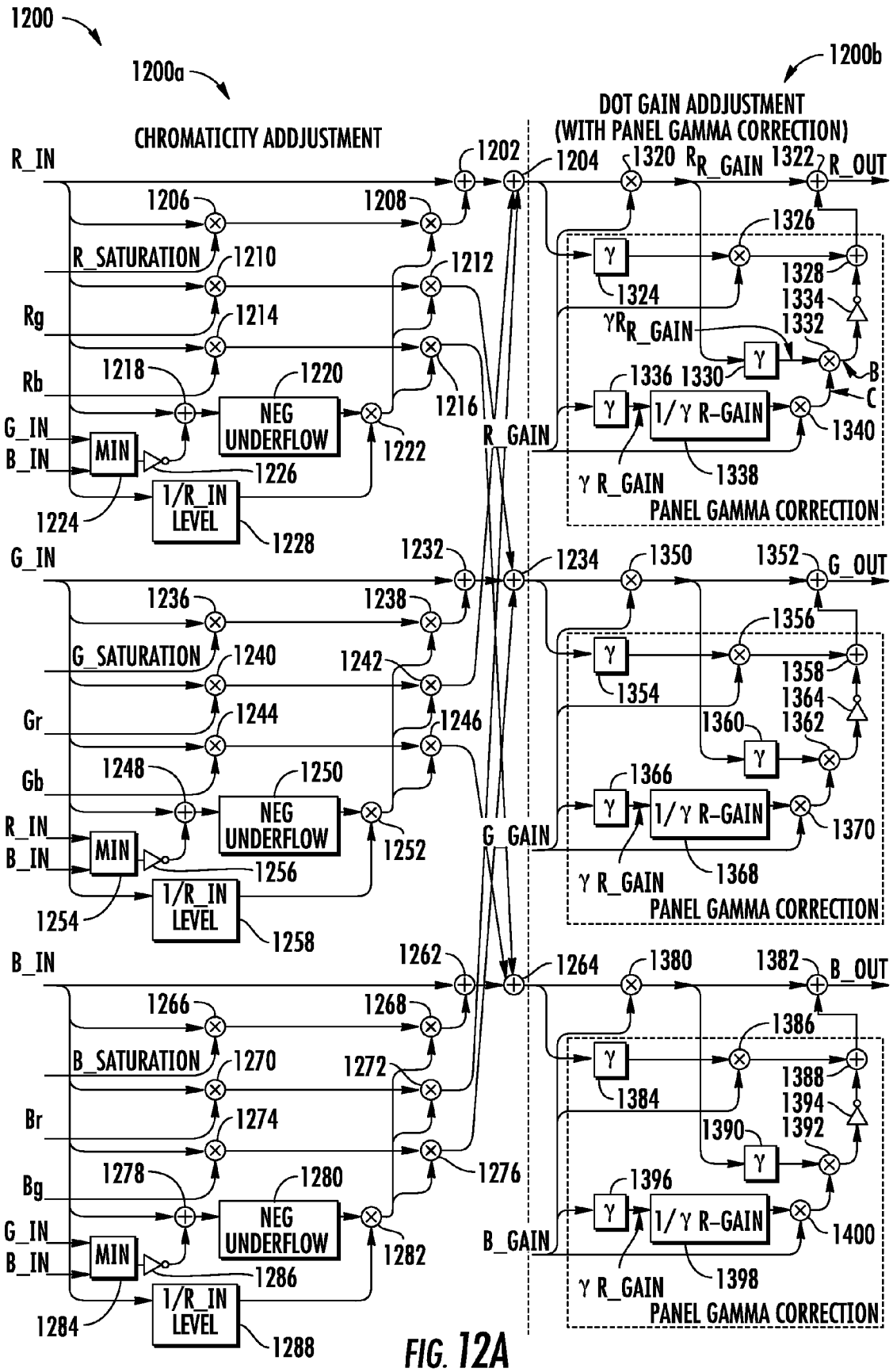
FIG. 12A illustrates processing performed on input red, green and blue image data in accordance with the disclosed principles.

The chromaticity adjustment module 1124, which is shown in more detail in FIG. 12A at 1200*a*, performs, based on a chromaticity adjustment signal from CPU 1120, chromaticity adjustment for the input image data. A dot gain adjustment module 1126, which is shown in more detail in FIG. 12A at 1200*b*, inputs the chromaticity adjusted data and performs, based on the chromaticity control signal, dot gain adjustment on this image data. SDI transmitter 1128 transmits the dot gain adjusted image data OUT1.

FIG. 12A illustrates processing 1200 performed on input red R_IN, green G_IN and blue B_IN image data by the processing module 1100 or other module within the processor 210. In a desired embodiment, the method 1200 is implemented in software, stored in a computer readable medium, which could be a random access memory (RAM) device, non-volatile random access memory (NVRAM) device, or a read-only memory (ROM) device) and executed by the processor 210 or other suitable controller for the video screen. The processing 1200 illustrated in FIG. 12A includes chromaticity adjustment processing 1200*a* and dot gain correction processing 1200*b*. In the illustrated embodiment, the dot gain correction processing 1200*b* includes panel gamma correction.

For chromaticity adjustment 1200*a*, the red image data R_IN is input at adders 1202, 1218, multipliers 1206, 1210, 1214, and leveler 1228. Red saturation data R_SATURATION is input at multiplier 1206 (using R slider 1004) and combined with the red image data R_IN, multiplier 1206 thus coordinates red saturation. Rg is input at multiplier 1210 (using Rg slider 1004) and combined with red image data R_IN; multiplier 1210 thus corrects Rg in the red image data R_IN. Rb is input (using Rb slider 1004) at multiplier 1214 and combined with red image data R_IN; multiplier 1214 thus corrects Rb in the red image data R_IN. Green image data G_IN and blue image data B_IN are input at a minimizing block 1224, which calculates the green and blue minimum. The inverted output, via inverter 1226, of the minimizing block 1224 is input at adder 1218 to be combined with red image data R_IN. A combination of the inverter 1226 and the adder 1218 functions to subtract the green and blue minimum from the red image data R_IN. A negative underflow function 1220 inputs the output of adder 1218 and is picked up by only an anode-related signal. Multiplier 1222 combines the outputs of negative underflow function 1220 and leveler 1228. The output of multiplier 1222 is input at multipliers 1208, 1212, 1216 to be combined with the outputs of multipliers 1206, 1210, 1214, respectively. Multiplier 1208 revises the red image data R_IN with green image data G_IN and blue image data B_IN and a small portion of red saturation data R_SATURATION. The output of multiplier 1208 is added to the red image data R_IN at adder 1202. Adder 1202 adds a red saturation signal to the red image data R_IN. Adder 1202 also creates an output that is sent to adder 1204, which functions to add green and blue revisions to the red image data R_IN. Multiplier 1212 revises the Rg component of the red image data R_IN only, and further revises this revised image data with green image data G_IN and blue image data B_IN.

Figure 12B:
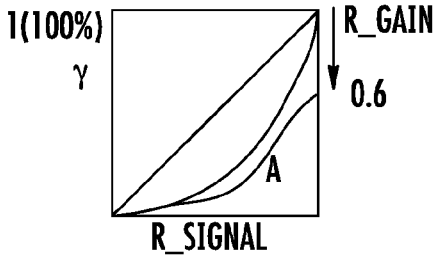
FIGS. 12B-F illustrate graphs related to the processing illustrated in FIG. 12A.
Figure 12C:
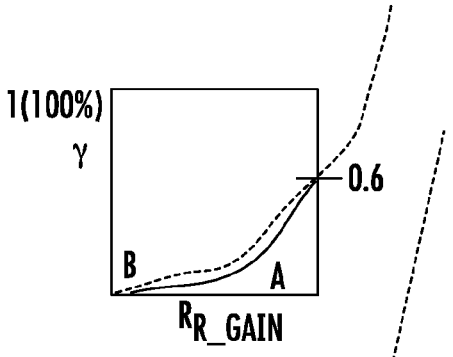

Multiplier 1212 creates an output that is sent to adder 1234, which adds red and blue revisions to the green image data G_IN. Multiplier 1216 revises the Rb component of the red image data R_IN only, and further revises this revised image data with green image data G_IN and blue image data B_IN. Multiplier 1216 creates an output that is sent to adder 1264, which adds read and green revisions to blue image data B_IN. Multiplier 1222 calculates the primary color (in this case, red) and the secondary color ratio, without being influenced by R_IN level, as is illustrated in FIG. 12F. In leveler 1228, when R_IN LEVEL=1(1023), the output of leveler 1228 is 1; when R_IN LEVEL=0.5(511), the output is 2. Based on these outputs of leveler 1228, it can be seen from FIG. 12F that when the input signal is a white signal, the white balance has no influence.

The green image data G_IN is input at adders 1232, 1248, multipliers 1236, 1240, 1244, and leveler 1258. Green saturation data G_SATURATION is input (using G slider 1006) at multiplier 1236 and combined with the green image data G_IN, multiplier 1236 thus coordinates green saturation. Gr is input (using Gr slider 1006) at multiplier 1240 and combined with green image data G_IN; multiplier 1240 thus corrects Gr in the green image data G_IN. Gb is input (using Gb slider 1006) at multiplier 1244 and combined with green image data G_IN; multiplier 1244 thus corrects Gb in the green image data G_IN. Red image data R_IN and blue image data B_IN are input at a minimizing block 1254, which calculates the red and blue minimum. The inverted output, via inverter 1256, of the minimizing block 1254 is input at adder 1248 to be combined with green image data G_IN. A combination of the inverter 1256 and the adder 1248 functions to subtract the red and blue minimum from the green image data G_IN. A negative underflow function 1250 inputs the output of adder 1248 and is picked up by only an anode-related signal. Multiplier 1252 combines the outputs of negative underflow function 1250 and leveler 1258. The output of multiplier 1252 is input at multipliers 1238, 1242, 1246 to be combined with the outputs of multipliers 1236, 1240, 1244, respectively. Multiplier 1238 revises the green image data G_IN with red image data R_IN and blue image data B_IN and a small portion of green saturation data G_SATURATION. The output of multiplier 1238 is added to the green image data G_IN at adder 1232. Adder 1232 adds a green saturation signal to the green image data G_IN. Adder 1232 also creates an output that is sent to adder 1234, which adds red and blue revisions to the green image data G_IN. Multiplier 1242 revises the Gr component of the green image data G_IN only, and further revises this revised image data with red image data R_IN and blue image data B_IN. Multiplier 1242 creates an output that is sent to adder 1204, which adds green and red revisions to the green image data G_IN. Multiplier 1246 revises the Gb component of the green image data G_IN only, and further revises this revised image data with red image data R_IN and blue image data B_IN. Multiplier 1246 creates an output that is sent to adder 1264, which adds red and green revisions to blue image data B_IN.

The blue image data B_IN is input at adders 1262, 1278, multipliers 1266, 1270, 1274, and leveler 1288. Blue saturation data B_SATURATION is input (using B slider 1008) at multiplier 1266 and combined with the blue image data B_IN, multiplier 1266 thus coordinates blue saturation. Br is input (using Br slider 1008) at multiplier 1270 and combined with blue image data B_IN; multiplier 1270 thus corrects Br in the blue image data B_IN. Bg is input (using Bg slider 1008) at multiplier 1274 and combined with blue image data B_IN; multiplier 1274 thus corrects Bg in the blue image data B_IN. Green image data G_IN and red image data R_IN are input at a minimizing block 1284, which calculates the green and red minimum. The inverted output, via inverter 1286, of the minimizing block 1284 is input at adder 1278 to be combined with blue image data B_IN. A combination of the inverter 1286 and the adder 1278 functions to subtract the green and red minimum from the blue image data B_IN. A negative underflow function 1280 inputs the output of adder 1278 and is picked up by only an anode-related signal. Multiplier 1282 combines the outputs of negative underflow function 1280 and leveler 1288. The output of multiplier 1282 is input at multipliers 1268, 1272, 1276 to be combined with the outputs of multipliers 1266, 1270, 1274, respectively. Multiplier 1268 revises the blue image data B_IN with green image data G_IN and red image data R_IN and a small portion of blue saturation data B_SATURATION. The output of multiplier 1268 is added to the blue image data B_IN at adder 1262. Adder 1262 adds a blue saturation signal to the blue image data B_IN. Adder 1262 also creates an output that is sent to adder 1264, which adds red and green revisions to the blue image data B_IN. Multiplier 1272 revises the Br component of the blue image data B_IN only, and further revises this revised image data with red image data R_IN and green image data G_IN. Multiplier 1272 creates an output that is sent to adder 1204, which adds green and blue revisions to the red image data R_IN. Multiplier 1276 revises the Bg component of the blue image data B_IN only, and further revises this revised image data with green image data G_IN and red image data R_IN. Multiplier 1276 creates an output that is sent to adder 1234, which adds red and blue revisions to green image data G_IN.

For dot gain adjustment 1200*b*, the red gain R_GAIN is input at a multiplier 1320, multiplier 1326, gamma correction block 1336, and multiplier 1340. The output of adder 1204 is input at multiplier 1320 and gamma correction block 1324. Multiplier 1320 adjusts the level of the red signal R_signal to result in $R_{R_GAIN}$. A combination of the gamma correction block 1324 and multiplier 1326 adds gamma to the red signal and adjusts the red gain R_GAIN to result in signal "A", which is illustrated graphically in FIGS. 12B and 12C.

Figure 12E:
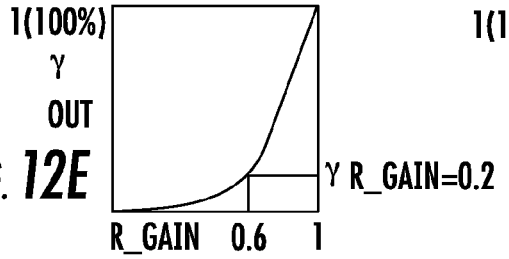

Gamma correction block 1336 adds gamma to red gain R_GAIN to result in $\gamma_{R_GAIN}$; when red gain R_GAIN is 1, gamma is 100%; see FIG. 12E. This output of gamma correction block 1336 $\gamma R_{GAIN}$ is input at an inversion block 1338, which outputs $1/\gamma R_{GAIN}$ to multiplier 1340. The outputs of gamma correction block 1330 and multiplier 1340 are input at multiplier 1332. Multiplier 1340 multiplies red gain R_GAIN by 1/γR_GAIN of inversion block 1338 in accordance with the following Equation 1 to result in signal "C":

$$C=R_\text{GAIN}\times(1/\gamma_{R_GAIN})=0.6\times(1/0.2)=3 \quad \text{(Equation 1)}$$

Figure 12D:
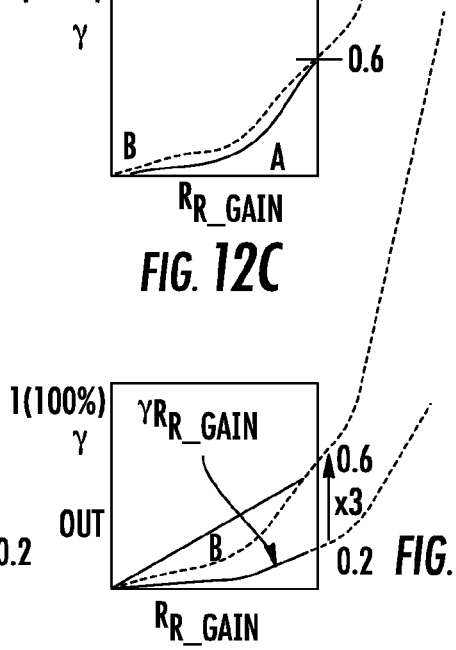
Figure 12F:
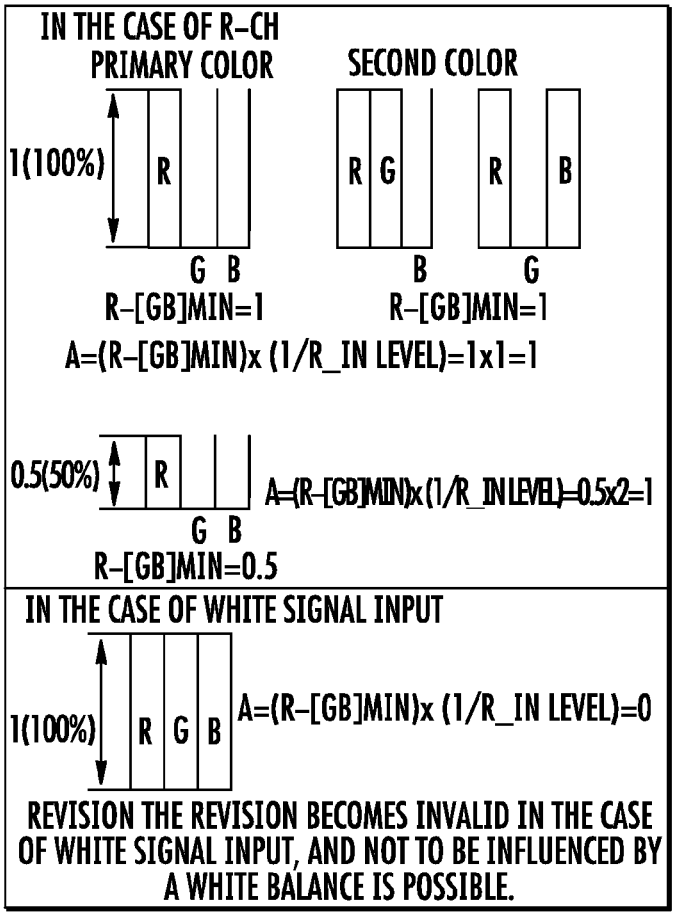

Gamma correction block 1330 adds gamma to $R_{R_GAIN}$ to result in $\gamma R_{R_GAIN}$. A combination of gamma correction block 1330 and multiplier 1332 adds gamma to signal "C", see FIG. 12D is based on the following Equation 2 to result in signal "B" shown in FIGS. 12A, 12C, and 12D:

$$B=C\times\gamma R_{R_GAIN}=3\times0.2=0.6 \quad \text{(Equation 2)}$$

The output of multiplier 1332, that is signal "B", is inverted by inverter 1334 and added to the output of multiplier 1326, that is signal "A", at adder 1328. A combination of inverter 1334 and adder 1328 thus functions to obtain a correction signal based on a difference between signals "A" and "B". See FIG. 12C. The output of adder 1328 is input at adder 1322, which adds gamma correction to $R_{R_GAIN}$. The output of adder 1322 is used as the corrected red output image data R_OUT.

The gamma of the panel is prescribed at 100% of white levels. A 100% level changes when red gain R_GAIN is adjusted and the gamma properties change. Even if the red panel gamma correction block changes the red gain R_GAIN, gamma properties are corrected.

The green gain G_GAIN is input at a multiplier 1350, multiplier 1356, gamma correction block 1366 and multiplier 1370. The output of adder 1234 is input at multiplier 1350 and gamma correction block 1354. The output of gamma correction block 1354 and green gain G_GAIN are combined at multiplier 1356. The output of multiplier 1350 is input at adder 1352 and gamma correction block 1360. The output of gamma correction block 1366 is input at an inversion block 1368, which outputs $1/\gamma\ G_{GAIN}$ to multiplier 1370. The outputs of gamma correction block 1370 and multiplier 1360 are combined at multiplier 1362. The output of multiplier 1362 is inverted by inverter 1364 and added to the output of multiplier 1356 at adder 1358. The output of adder 1358 is input at adder 1352 to be combined with the output of multiplier 1350. The output of adder 1352 is used as the corrected green output image data G_OUT.

The blue gain B_GAIN is input at a multiplier 1380, multiplier 1386, gamma correction block 1396 and multiplier 1400. The output of adder 1264 is input at multiplier 1380 and gamma correction block 1384. The output of gamma correction block 1384 and blue gain B_GAIN are combined at multiplier 1386. The output of multiplier 1380 is input at adder 1382 and gamma correction block 1390. The output of gamma correction block 1396 is input at an inversion block 1398, which outputs $1/\gamma\ B_{GAIN}$ to multiplier 1400. The outputs of gamma correction block 1400 and multiplier 1390 are combined at multiplier 1392. The output of multiplier 1392 is inverted by inverter 1394 and added to the output of multiplier 1386 at adder 1388. The output of adder 1388 is input at adder 1382 to be combined with the output of multiplier 1380. The output of adder 1382 is used as the corrected blue output image data B_OUT.

The green gain G_GAIN and the blue gain B_GAIN portions of the dot gain adjustment 1200*b* function similarly to that of the red gain R_GAIN described above. Some of the details with respect to the dot gain adjustment 1200*b* of the green gain G_GAIN and blue gain B_GAIN are omitted merely for the sake of brevity. One of ordinary skill in the art would understand the functioning of the dot gain adjustment 1200*b* of the green gain G_GAIN and of the blue gain B_GAIN from the description and illustration of the dot gain adjustment above with respect to the red gain R_GAIN.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of performing color matching for a light emitting video screen comprising a plurality of light emitting panels arranged in a layout, said method comprising:

capturing, using an image sensing device, a displayed output of a first light emitting panel of the plurality of light emitting panels;

generating, at a processor, master data from the captured displayed output of the first light emitting panel of the plurality of light emitting panels;

generating, at the processor, correction data for each remaining light emitting panel, the respective correction data being based on a respective displayed output of a respective remaining light emitting panel and the master data;

assigning, at the processor, the master data associated with the first light emitting panel to a location in the layout corresponding to a location of the first light emitting panel in the screen; and for each remaining light emitting panel, assigning, at the processor, the correction data associated with a respective remaining light emitting panel to a location in the layout corresponding to a location of the respective remaining light emitting panel in the screen.

2. The method of claim 1, further comprising fine tuning the correction data for at least one remaining light emitting panel.

3. The method of claim 2, wherein the at least one remaining light emitting panel comprises a plurality of light emitting modules and the act of fine tuning comprises:

adjusting a red, green, and blue ratio of at least one of the light emitting modules to be below a first predetermined value and to be above a second predetermined value.

4. The method of claim 2, wherein the act of fine tuning comprises:

adjusting one or more of a chromaticity, hue and luminance of red, green, and blue components of the at least one remaining light emitting panel.

5. The method of claim 2, wherein the at least one remaining light emitting panel comprises a plurality of light emitting modules and the act of fine tuning comprises:

adjusting one or more of a chromaticity, hue and luminance of red, green, and blue components of at least one of the light emitting modules.

6. The method of claim 1, wherein the master data is generated based on a portion of the displayed output from the first light emitting panel, the portion corresponding to a marked area of an image on a display device, and wherein the image corresponds to the displayed output.

7. The method of claim 1, wherein the correction data is generated based on a portion of each displayed output from the remaining light emitting panels, the respective portions corresponding to a marked area of a respective image on a display device, and wherein the respective images correspond to the respective displayed outputs.

8. The method of claim 1, wherein the master data comprises gain, chromaticity, hue and luminance information output from red, green and blue light emitting diodes within the first light emitting panel.

9. The method of claim 1, wherein the correction data comprises gain, chromaticity, hue and luminance information output from red, green and blue light emitting diodes within the remaining light emitting panels.

10. The method of claim 1, wherein the correction data is generated for each panel by adjusting red, green and blue ratio of the respective remaining light emitting panel, while maintaining a white balance ratio of the respective remaining light emitting panel that is similar to a white balance ratio of the first light emitting panel.

11. A method of performing color matching for a light emitting video screen comprising a plurality of light emitting panels arranged in a layout, said method comprising:

generating, at a processor, master data from a displayed output of a first light emitting panel of the plurality of light emitting panels;

generating, at the processor, correction data for each remaining light emitting panel, the respective correction data being based on a respective displayed output of a respective remaining light emitting panel and the master data;

fine tuning, at the processor, the correction data for at least one remaining light emitting panel, the fine tuning including adjusting a color ratio of the at least one remaining light emitting panel to be below a first predetermined value and to be above a second predetermined value;

assigning, at the processor, the master data associated with the first light emitting panel to a location in the layout corresponding to a location of the first light emitting panel in the screen; and for each remaining light emitting panel, assigning, at the processor, the correction data associated with a respective remaining light emitting panel to a location in the layout corresponding to a location of the respective remaining light emitting panel in the screen.

12. A video processor programmed to execute a method of performing color matching for a light emitting video screen comprising a plurality of light emitting panels arranged in a layout, said video processor being programmed to:

capture, using an image sensing device, a displayed output of a first light emitting panel of the plurality of light emitting panels;

generate master data from the captured displayed output of the first light emitting panel of the plurality of light emitting panels;

generate correction data for each remaining light emitting panel, the respective correction data being based on a respective displayed output of a respective remaining light emitting panel and the master data;

assign the master data associated with the first light emitting panel to a location in the layout corresponding to a location of the first light emitting panel in the screen;

for each remaining light emitting panel, assign the correction data associated to a respective remaining light emitting panel to a location in the layout corresponding with a location of the respective remaining light emitting panel in the screen; and perform color matching on the remaining light emitting panels in the screen based on the respective correction data.

13. The video processor of claim 12, wherein the processor is further programmed to fine tune the correction data for at least one remaining light emitting panel.

14. The video processor of claim 13, wherein the act of fine tuning comprises:

adjusting a red, green, and blue ratio of the at least one remaining light emitting panel to be below a first predetermined value and to be above a second predetermined value.

15. The video processor of claim 13, wherein the at least one remaining light emitting panel comprises a plurality of light emitting modules and the act of fine tuning comprises:

adjusting a red, green, and blue ratio of at least one of the light emitting modules to be below a first predetermined value and to be above a second predetermined value.

16. The video processor of claim 13, wherein the act of fine tuning comprises:

adjusting one or more of a chromaticity, hue and luminance of red, green, and blue components of the at least one remaining light emitting panel.

17. The video processor of claim 13, wherein the at least one remaining light emitting panel comprises a plurality of light emitting modules and the act of fine tuning comprises:

adjusting one or more of a chromaticity, hue and luminance of red, green, and blue components of at least one of the light emitting modules.

18. The video processor of claim 12, wherein the master data is generated based on a portion of the displayed output from the first light emitting panel, the portion corresponding to a marked area of an image on a display device, and wherein the image corresponds to the displayed output.

19. The video processor of claim 12, wherein the correction data is generated based on a portion of each displayed output from the remaining light emitting panels, the respective portions corresponding to a marked area of a respective image on a display device, and wherein the respective images correspond to the respective displayed outputs.

20. The video processor of claim 12, wherein the master data comprises gain, chromaticity, hue and luminance information output from red, green and blue light emitting diodes within the first light emitting panel.

21. The video processor of claim 12, wherein the correction data comprises gain, chromaticity, hue and luminance information output from red, green and blue light emitting diodes within the remaining light emitting panels.

22. The video processor of claim 12, wherein the correction data is generated for each panel by adjusting red, green and blue ratio of the respective remaining light emitting panel, while maintaining a white balance ratio of the respective remaining light emitting panel that is similar to a white balance ratio of the first light emitting panel.

23. The video processor of claim 12, wherein the video processor is further programmed to fine tune the respective correction data for at least one respective remaining light emitting panel, the fine tuning comprising adjusting a color ratio of the at least one respective remaining light emitting panel to be below a first predetermined value and to be above a second predetermined value.

* * * * *